US009121315B2

(12) United States Patent
Abram et al.

(10) Patent No.: US 9,121,315 B2
(45) Date of Patent: Sep. 1, 2015

(54) PASSIVE VALVE WITH STOP PAD

(75) Inventors: Kwin Abram, Columbus, IN (US); Govindaraj Kalyanasamy, Indianapolis, IN (US); Robin Willats, Columbus, IN (US)

(73) Assignee: Faurecia Emissions Control Technologies, USA, LLC, Columbus, IN (US)

( * ) Notice: Subject to any disclaimer, the term of this patent is extended or adjusted under 35 U.S.C. 154(b) by 2226 days.

(21) Appl. No.: 12/013,652

(22) Filed: Jan. 14, 2008

(65) Prior Publication Data

US 2009/0126359 A1 May 21, 2009

Related U.S. Application Data

(60) Provisional application No. 60/989,508, filed on Nov. 21, 2007.

(51) Int. Cl.

| | |
|---|---|
| ***F01N 1/00*** | (2006.01) |
| ***F01N 1/02*** | (2006.01) |
| ***F01N 13/08*** | (2010.01) |
| ***F02D 9/04*** | (2006.01) |
| ***F02D 9/10*** | (2006.01) |

(52) U.S. Cl.

CPC *F01N 1/02* (2013.01); *F01N 13/08* (2013.01); *F02D 9/04* (2013.01); *F02D 9/1025* (2013.01); *F02D 9/1065* (2013.01); *F01N 2240/36* (2013.01); *F01N 2260/06* (2013.01)

(58) Field of Classification Search

USPC ..... 60/272, 292, 324; 137/601.11, 601.17; 251/305

See application file for complete search history.

(56) References Cited

U.S. PATENT DOCUMENTS

| | | | | |
|---|---|---|---|---|
| 5,630,571 | A * | 5/1997 | Kipp et al. | 251/214 |
| 6,179,096 | B1 * | 1/2001 | Kinerson et al. | 188/154 |
| 6,694,727 | B1 * | 2/2004 | Crawley et al. | 60/295 |
| 6,752,106 | B2 | 6/2004 | Hedman | |
| 6,889,672 | B2 | 5/2005 | Criddle et al. | |
| 7,032,563 | B2 * | 4/2006 | Nakagome et al. | 123/198 E |
| 7,275,367 | B2 * | 10/2007 | Tamura et al. | 60/324 |
| 7,536,990 | B2 * | 5/2009 | Willats et al. | 123/323 |
| 7,712,312 | B2 * | 5/2010 | Sexton | 60/602 |
| 2005/0155816 | A1 | 7/2005 | Alcini et al. | |
| 2007/0062757 | A1 | 3/2007 | Arbuckle et al. | |

OTHER PUBLICATIONS

International Search Report and Written Opinion dated Jun. 5, 2009.

* cited by examiner

*Primary Examiner* — Binh Q Tran

(74) *Attorney, Agent, or Firm* — Carlson, Gaskey & Olds, PC

(57) ABSTRACT

A passive valve assembly for an exhaust component includes a vane that is positioned within an exhaust gas flow path. The vane is pivoted from a closed position to an open position in response to exhaust gas flow overcoming a biasing force. A stop is positioned within the exhaust component and cooperates with the vane to define a closed position for the vane.

23 Claims, 3 Drawing Sheets

PASSIVE VALVE WITH STOP PAD

RELATED APPLICATIONS

This application claims priority to provisional application No. 60/989,508 filed on Nov. 21, 2007.

TECHNICAL FIELD

The subject invention relates to a passive valve in a vehicle exhaust system, and more particularly to a passive valve with a stop pad that facilitates noise reduction while also improving valve performance and durability.

BACKGROUND OF THE INVENTION

Exhaust systems are widely known and used with combustion engines. Typically, an exhaust system includes exhaust tubes that convey hot exhaust gases from the engine to other exhaust system components, such as mufflers, resonators, etc. Mufflers and resonators include acoustic chambers that cancel out sound waves carried by the exhaust gases. Although effective, these components are often relatively large in size and provide limited nose attenuation.

Attempts have been made to improve low frequency noise attenuation by either increasing muffler volume or increasing backpressure. Increasing muffler volume is disadvantageous from a cost, material, and packaging space perspective. Increasing backpressure can adversely affect engine power.

Another solution for reducing low frequency noise is to use a passive valve assembly. The passive valve assembly includes a flapper valve body or vane that is positioned within an exhaust pipe, with the vane being pivotable between an open position and a closed position. The passive valve is spring biased toward the closed position, and when exhaust gas pressure is sufficient to overcome this spring bias, the vane is pivoted toward the open position. When the exhaust gas pressure falls, the spring causes the vane to return to the closed position.

With the use of the spring, it is difficult to return the vane to a consistent closed position within the exhaust pipe. Further, while effective at attenuating low frequency noise, the introduction of the passive valve into the exhaust system presents additional noise challenges. For example, when the spring returns the vane to the closed position, closing noise is generated, which is undesirable.

Therefore, there is a need to provide a passive valve arrangement that can effectively and efficiently return a vane to a consistent closed position without generating additional noise. Further, the passive valve arrangement should minimize closing forces to improve durability of the passive valve.

SUMMARY OF THE INVENTION

A passive valve includes a vane that is positioned within an exhaust gas flow path. The vane is supported by a shaft and is pivotable between open and closed positions. A stop is also positioned within the exhaust gas flow path and defines a closed position for the vane.

In one example, the vane comprises a body structure that has a first portion coupled to the shaft. The body structure extends from the first portion to a tip. When in the closed position, the tip of the body structure engages the stop. In this configuration, the stop is positioned furthest from an axis of rotation defined by the shaft. This reduces contact forces between the stop and the vane to provide improved durability.

In one example, the stop is formed as one piece with the wall of the exhaust component. In this configuration, a tool indents a portion of the wall to form the stop.

In one example, the stop comprises a ramped surface that begins upstream of the vane. An exhaust component has a wall with an external surface and an internal surface that defines the exhaust gas flow path. The ramped surface extends from the internal surface of the wall toward the vane. A stop end surface then extends from the ramped surface back toward the internal surface of the wall. The tip of the vane engages the stop end surface when the passive valve is in the closed position. The upstream ramped surface reduces backpressure, turbulence, and the generation of flow noise.

In one example, the stop includes a duckbill portion that is positioned upstream of said ramped surface. The duckbill portion is curved to facilitate attachment to the internal surface of the exhaust component.

These and other features of the present invention can be best understood from the following specification and drawings, the following of which is a brief description.

DETAILED DESCRIPTION OF THE PREFERRED EMBODIMENT

Figure 1:
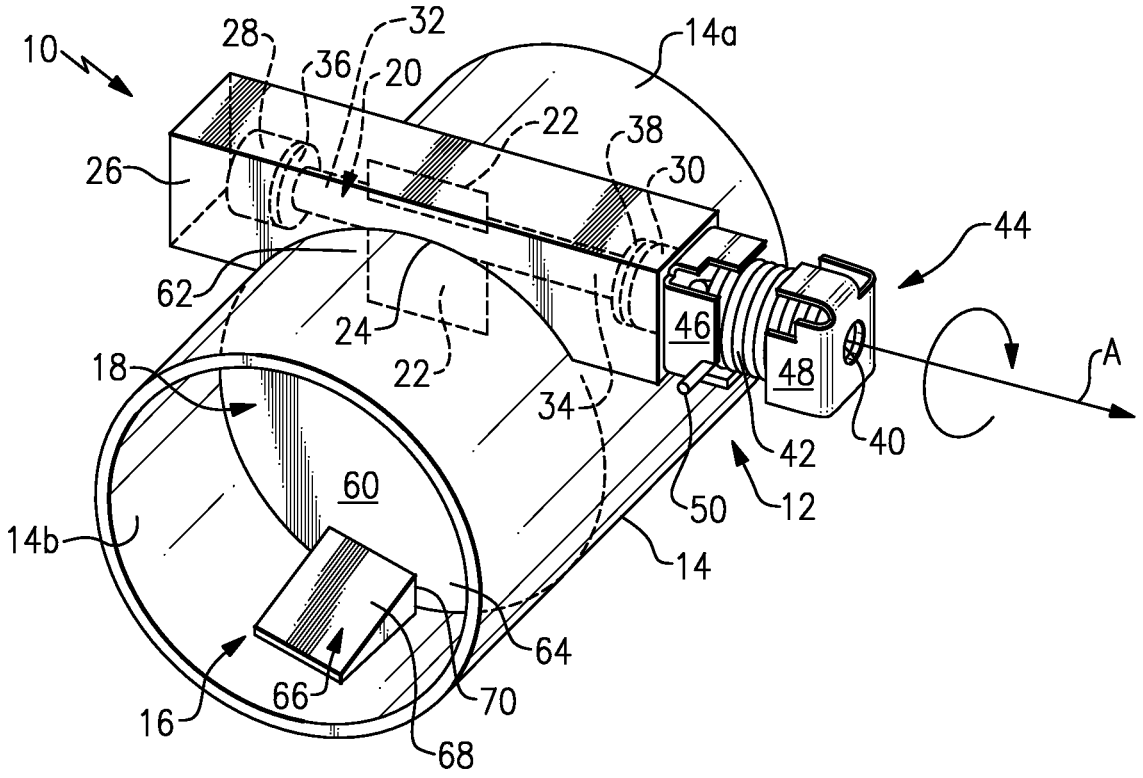
FIG. 1 shows a perspective view of one example of an exhaust component and passive valve assembly.

As shown in FIG. 1, an exhaust component, such as an exhaust tube or pipe 10 includes an exhaust throttling valve, referred to as a passive valve assembly 12. The passive valve assembly 12 is movable between an open position where there is minimal blockage of an exhaust gas flow path 16 and a closed position where a substantial portion of the exhaust gas flow path 16 is blocked. The passive valve assembly 12 is resiliently biased toward the closed position and is moved toward the open position when exhaust gas flow generates a pressure sufficient enough to overcome the biasing force.

In the example shown, the exhaust pipe 10 comprises a single pipe body 14 that defines the exhaust gas flow path 16. In one example, the pipe body 14 includes a curved outer surface 14*a* and a curved inner surface 14*b* that defines the exhaust gas flow path 16. In one example, the pipe body 14 has a circular cross-section.

The passive valve assembly 12 includes a valve body or vane 18 that blocks a portion of the exhaust gas flow path 16 when in the closed position. As discussed above, the vane 18 is pivoted toward the open position to minimize blockage of the exhaust gas flow path 16 in response to pressure exerted against the vane 18 by exhaust gases.

In one example, the vane 18 is fixed to a shaft 20 with a connecting arm, shown schematically at 22 in FIG. 1. A slot 24 is formed within the curved outer surface 14*a* of the pipe body 14. A housing 26, shown in this example as a square metal structure, is received within this slot 24 and is welded to the pipe body 14. Other housing configurations could also be used. The shaft 20 is rotatably supported within the housing 26 by first 28 and second 30 bushings or bearings and defines an axis of rotation A.

The first bushing 28 is positioned generally at a first shaft end 32. The first bushing 28 comprises a sealed interface for the first shaft end 32. The shaft 20 includes a shaft body 34 that has a first collar 36 and a second collar 38. The first bushing 28 includes a first bore that receives the first shaft end 32 such that the first collar 36 abuts directly against an end face of the first bushing 28 to provide a sealed interface. As such, exhaust gases cannot leak out of the first bushing 28 along a path between the shaft 20 and first bushing 28.

The second bushing 30 includes a second bore through which the shaft body 34 extends to a second shaft end 40. The second collar 38 is located axially inboard of the second bushing 30. The shaft 20 extends through the second bore to an axially outboard position relative to the second bushing 30. A resilient member, such as a spring 42 for example, is coupled to the second shaft end 40 with a spring retainer 44. The spring retainer 44 includes a first retainer piece 46 that is fixed to the housing 26 and a second retainer piece 48 that is fixed to the second shaft end 40. One spring end 50 is associated with housing 26 via the first retainer piece 46 and a second spring end (not viewable in FIG. 1 due to the spring retainer 44) is associated with the shaft 20 via the second retainer piece 48.

The vane 18 comprises a body structure 60, such as a disc-shaped body for example, which includes a first portion 62 that is coupled to the shaft 20 with the connecting arm 22. The body structure 60 extends from the first portion 62 to a second portion that comprises a distal tip 64. As such, the tip 64 comprises a portion of the body structure 60 that is furthest from the axis of rotation A.

A stop 66 is supported by the pipe body 14 and is positioned within the exhaust gas flow path 16. The stop 66 defines the closed position for the vane 18. The tip 64 of the vane 18 engages the stop 66 when the spring 42 returns the vane 18 from the open position to the closed position.

Figure 2:
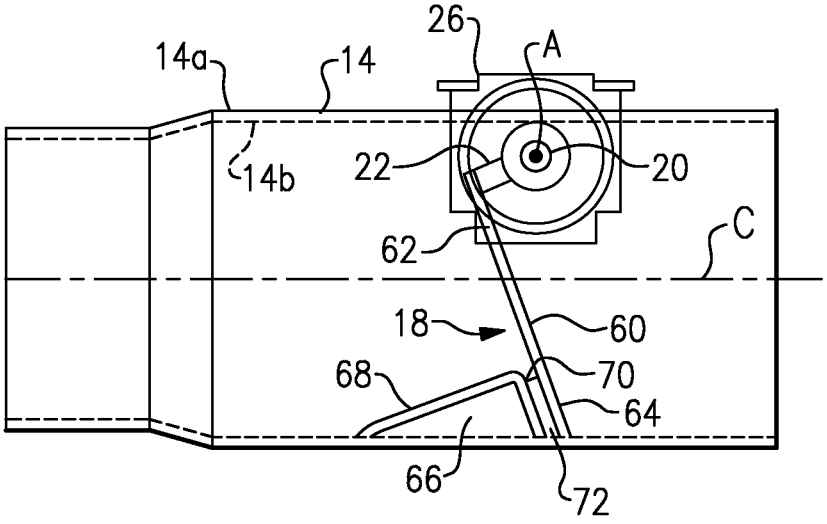
FIG. 2 shows a side view of an exhaust component with a stop for a vane.

In one example, as shown in FIGS. 1 and 2, the stop 66 comprises a ramped surface 68 that begins at the inner surface 14*b* at a position upstream from the vane 18 and extends outwardly away from the inner surface 14*b* and towards the vane 18. The ramped surface 68 then transitions into a stopper end surface 70 that extends back towards the inner surface 14*b*. The tip 64 of the vane 18 engages the stopper end surface 70 when in the closed position.

Figure 3A:
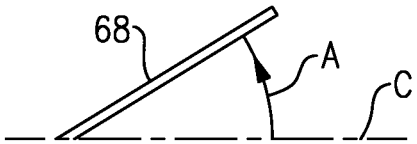
FIG. 3A is a schematic side view showing a ramp surface angle of the stop relative to a centerline of the exhaust component.
Figure 3B:
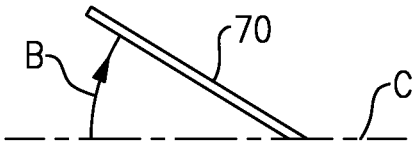
FIG. 3B is a schematic side view showing an end surface angle of the stop relative to the centerline of the exhaust component.

As shown in FIG. 2, the ramped surface 68 and the stopper end surface 70 are angled relative to the inner surface 14*b* of the pipe body 14. The pipe body 14 defines a pipe centerline C, which is shown in FIG. 2. As shown in FIG. 3, the ramped surface 68 is positioned at a ramp angle A that is within a range of 10 to 45 degrees relative to the pipe centerline C. Similarly, the stopper end surface 70 is positioned at an angle B relative to the pipe centerline C. In one example, the ramped surface 68 and the stopper end surface 70 are obliquely orientated relative to the inner surface 14*b* and relative to the pipe centerline C.

In one example, a pad 72 is supported on the stopper end surface 70 to provide a cushioned surface to engage the tip 64 of the vane 18. The pad 72 can be made from a mesh material or other similar material, for example, and can be attached to the stopper end surface 70 with any type of attachment method suitable for use within an exhaust component.

The stop 66 is positioned at the tip 64 of the vane 18 to minimize closing forces. By positioning these contact surfaces as far as possible from the axis of rotation A, contact forces are reduced, which in turn increases durability. Further, the upstream ramped surface 68 of the stop 66 reduces backpressure, turbulence, and the generation of additional flow noise.

Figure 4:
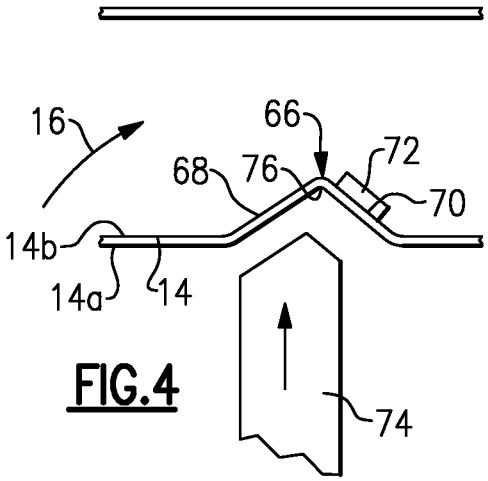
FIG. 4 is a schematic side view of one example of a stop.

In one example, the stop 66 is formed as one piece with the wall of the pipe body 14 as shown in FIG. 4. A tool 74 is used to indent a portion 76 of the pipe body 14 itself to form the stop 66. The pad 72 can then be attached to the stopper end surface 70 as discussed above.

Figure 5:
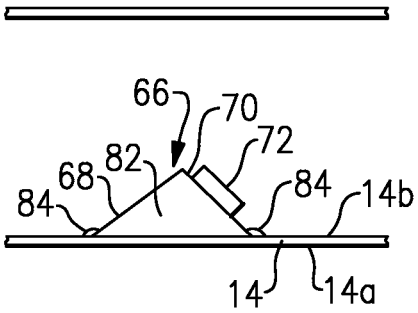
FIG. 5 is a schematic side view of another example of a stop.
Figure 6A:
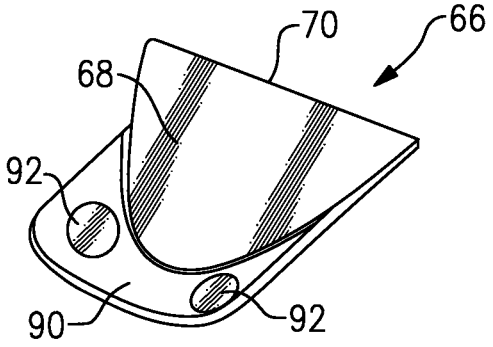
FIG. 6A is a perspective view of another example of a stop.
Figure 6B:
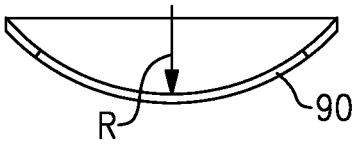
FIG. 6B is an end view of the stop of FIG. 6A.
Figure 6C:
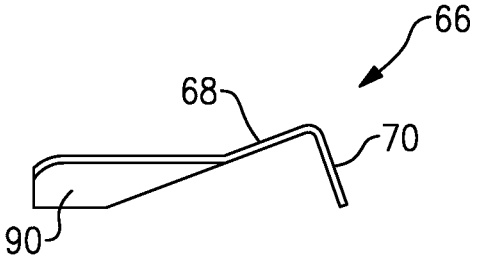
FIG. 6C is a side view of the stop of FIG. 6A.
Figure 6D:
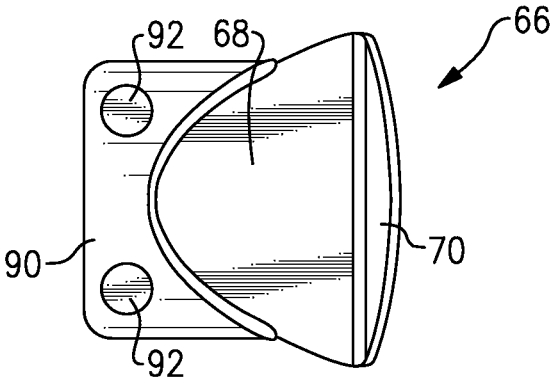
FIG. 6D is a top view of the stop of FIG. 6A.

In another example shown in FIG. 5, the stop 66 comprises a separate body 82 that is welded to the inner surface 14*b* of the pipe body 14 as indicated at 84. The pad 72 can then be attached as described above. The pad 72 and the separate body 82 can be made from common materials, or the pad 72 can be made from a different material that is attached to the stop 66.

In another example shown in FIGS. 6A-6D, the stop 66 comprises a duckbill portion 90 that is positioned upstream of the stopper end surface 70. The duckbill portion 90 has a radius of curvature R that is contoured to match the inner surface 14*b* of the pipe body 14. The duckbill portion 90 is spot welded, as indicated at 92, to the pipe body 14. The duckbill portion 90 transitions into the ramped surface 68, which in this example comprises a curved surface. The ramped surface 68 terminates at the stopper end surface 70, which extends back toward the inner surface 14*b* of the pipe body 14 in a direction away from a centerline of the pipe body 14. In the example shown, the duckbill portion 90 is formed as one-piece with the ramped surface 68 and the stopper end surface 70. A pad 72 can be attached to the stopper end surface 70 as described above.

The subject passive valve assembly with the stop 66 and pad 72 can effectively and efficiently return a vane 18 to a consistent, repeatable closed position without generating additional unwanted noise. Additionally, the pad 72 is positioned adjacent the tip 64 of the vane 18 to minimize closing forces and to improve durability of the passive valve assembly. Further, the orientation and position of the ramped surface 68 of the stop 66 also reduces noise in addition to reducing backpressure and turbulence.

Although an embodiment of this invention has been disclosed, a worker of ordinary skill in this art would recognize that certain modifications would come within the scope of this invention. For that reason, the following claims should be studied to determine the true scope and content of this invention.

What is claimed is:

1. A passive valve assembly for a vehicle exhaust system comprising:

an exhaust component defining an exhaust gas flow path;

a vane supported by a shaft and positioned within the exhaust gas flow path, said vane being pivotable between an open position and a closed position; and a stop positioned within said exhaust gas flow path to define the closed position for said vane.

2. The passive valve assembly according to claim 1 wherein said vane comprises a disc-shaped body having a first portion that is coupled to said shaft, said disc-shaped body extending from said first portion to a tip, and wherein said stop is positioned within said exhaust gas flow path to engage said tip.

3. The passive valve assembly according to claim 1 wherein said stop includes a padded surface that engages said vane when in said closed position.

4. The passive valve assembly according to claim 1 wherein said stop comprises a ramped surface that extends from an inner wall surface of said exhaust component toward said vane and a stopper end surface that extends from said ramped surface back toward said inner wall surface, said vane abutting against said stopper end surface when in said closed position.

5. The passive valve assembly according to claim 4 wherein said ramped surface is obliquely orientated relative to a centerline of said exhaust component.

6. The passive valve assembly according to claim 4 wherein said stopper end face surface is obliquely orientated relative to a centerline of said exhaust component.

7. The passive valve assembly according to claim 4 wherein said ramped surface begins at a position that is upstream from said vane.

8. The passive valve assembly according to claim 4 wherein said exhaust component defines a centerline that coincides with a center of the exhaust gas flow path, and wherein said ramped surface is orientated at an angle within a range of 10 to 45 degrees relative to said centerline.

9. The passive valve assembly according to 1 including a resilient member that biases said vane toward said closed position, said vane being pivoted from said closed position towards said open position in response to an exhaust gas flow that exceeds a biasing force of said resilient member, and wherein said resilient member moves said vane into abutting engagement with said stop when the exhaust gas flow is less than said biasing force of said resilient member.

10. The passive valve assembly according to 9 wherein said shaft defines an axis of rotation that is positioned adjacent one edge of said vane, and wherein said stop is positioned at an opposite edge of said vane from said axis of rotation.

11. The passive valve assembly according to claim 1 wherein said stop is integrally formed with said exhaust component as a single-piece component.

12. The passive valve assembly according to claim 1 wherein said stop comprises a duckbill portion having a shape that corresponds to an inner surface of said exhaust component, a ramped surface that extends from said duckbill portion toward a center of said exhaust component, and a stopper end surface that extends from said ramped surface in a direction away from said center of said exhaust component.

13. The passive valve assembly according to claim 12 wherein said exhaust component comprises an exhaust tube having a curved surface and wherein said duckbill portion comprises a curved surface that generally corresponds in shape to said curved surface of said exhaust tube.

14. A passive valve assembly for a vehicle exhaust system comprising:

an exhaust component comprising a wall with an external surface and an internal surface that defines an exhaust gas flow path;

a housing attached to said external surface;

a shaft supported within said housing by at least one bushing, said shaft defining an axis of rotation;

a vane supported by said shaft and positioned within the exhaust gas flow path, said vane being pivotable between an open position and a closed position, and wherein said vane comprises a body structure having a first portion coupled to said shaft with said body structure extending from said first portion to a tip;

a resilient member that biases said vane toward said closed position, said vane only being pivoted from said closed position towards said open position in response to an exhaust gas flow that exceeds a biasing force of said resilient member; and a stop positioned within said exhaust gas flow path to define said closed position for said vane, said tip of said body structure contacting said stop when in said closed position.

15. The passive valve assembly according to claim 14 wherein said stop includes a mesh pad that comprises a stop surface for contacting said tip.

16. The passive valve assembly according to claim 14 wherein said stop comprises a ramped surface that extends from said internal surface of said exhaust component toward said vane and a stopper end surface that extends from said ramped surface back toward said internal surface, said vane abutting against said stopper end surface when in said closed position.

17. The passive valve assembly according to claim 16 wherein said ramped surface and said stopper end surface are each obliquely orientated relative to a centerline of said exhaust component.

18. The passive valve assembly according to claim 14 wherein said ramped surface begins at a location that is upstream from said vane.

19. The passive valve assembly according to claim 14 wherein said stop is integrally formed as one piece with said wall of said exhaust component.

20. The passive valve assembly according to claim 14 wherein said internal surface of said exhaust component comprises a curved surface of a tube and wherein said stop includes a duckbill portion with a mating curved surface that corresponds to said curved surface of said tube, said duckbill surface transitioning to a curved ramped surface that extends in a direction toward a centerline of said tube, and with said curved ramped surface then transitioning to a stopper end surface that extends in a direction away from said centerline, said stopper end surface defining said closed position for said vane.

21. The passive valve assembly according to claim 1 including a resilient member that biases said vane toward said closed position, and wherein said vane is only pivoted from said closed position towards said open position in response to an exhaust gas flow that exceeds a biasing force of said resilient member.

22. The passive valve assembly according to claim 1 wherein said vane comprises a single piece, disc-shaped body that substantially blocks an entire cross-section of the exhaust gas flow path when in the closed position, said shaft being attached to said vane adjacent an outer peripheral edge of said disc-shaped body such that said shaft is offset from a center of said disc-shaped body.

23. The passive valve assembly according to claim 14 wherein said exhaust component defines a central axis extending along a length of said exhaust component, and wherein said axis of rotation does not intersect said central axis.

* * * * *